US005669053A

United States Patent [19]

Hashizume et al.

[11] Patent Number: 5,669,053

[45] Date of Patent: Sep. 16, 1997

[54] ROLLER TRANSFER DEVICE AND TRANSFER ROLLER MANUFACTURING METHOD

[75] Inventors: Hiroshi Hashizume; Yoshiaki Okano, both of Hino, Japan

[73] Assignee: Kabushiki Kaisha TEC, Shizuoka, Japan

[21] Appl. No.: 514,954

[22] Filed: Aug. 14, 1995

[30] Foreign Application Priority Data

Aug. 17, 1994 [JP] Japan ..... 6-193279

[51] Int. Cl.[6] ..... G03G 15/16

[52] U.S. Cl. ..... 399/313

[58] Field of Search ..... 355/271, 274, 355/277, 282, 285, 289, 290; 399/297, 313, 314; 430/126

[56] References Cited

U.S. PATENT DOCUMENTS

| | | | |
|---|---|---|---|
| 3,955,530 | 5/1976 | Knechtel | 118/60 |
| 4,147,832 | 4/1979 | Namiki | 428/375 |
| 4,338,017 | 7/1982 | Nishikawa | 355/272 |
| 4,375,505 | 3/1983 | Newkirk | 430/99 |
| 4,842,944 | 6/1989 | Kuge et al. | 428/451 |
| 4,874,927 | 10/1989 | Shibata et al. | 219/469 |
| 5,035,950 | 7/1991 | Del Rosario | 428/421 |
| 5,057,875 | 10/1991 | Itoh | 355/326 R |
| 5,264,902 | 11/1993 | Suwa et al. | 355/282 |
| 5,420,679 | 5/1995 | Goto et al. | 355/285 |
| 5,438,398 | 8/1995 | Tanigawa et al. | 355/271 |
| 5,489,747 | 2/1996 | Takenaka et al. | 118/653 |

FOREIGN PATENT DOCUMENTS 5-107794 4/1993 Japan .

*Primary Examiner*—William J. Royer

*Attorney, Agent, or Firm*—Frishauf, Holtz, Goodman, Langer & Chick

[57] ABSTRACT

Disclosed is a transfer device using a transfer roller including a conductive elastic layer having a heat resistance not less than 180° C., an adhesive layer formed on the conductive elastic layer, and a fluorine-based film resistance layer formed on the adhesive layer, or a transfer roller in which the adhesive strength between an adhesive layer formed on a conductive elastic layer and a fluorine-based film resistance layer formed on the adhesive layer is 150 g/cm or higher.

16 Claims, 2 Drawing Sheets

ROLLER TRANSFER DEVICE AND TRANSFER ROLLER MANUFACTURING METHOD

BACKGROUND OF THE INVENTION

1. Field of the Invention

The present invention relates to a roller transfer device for use in an electrophotographic apparatus of, e.g., a facsimile, a laser printer, and a copying machine.

2. Description of the Related Art

FIG. 1 shows an example of an electrophotographic apparatus used as a recording section of a facsimile or a printer.

In FIG. 1, reference numeral 1 denotes a photoreceptor drum manufactured by coating a photoconductive material on the outer circumferential surface of a cylindrical aluminum tube element. A charger 2, an exposing device 3, a developing unit 4, a roller transfer device 5, and a cleaning unit 6 are arranged along the outer circumferential surface of the photoreceptor drum 1.

This electrophotographic apparatus performs image formation by the action explained below.

The charger 2 charges the photoconductive layer of the photoreceptor drum 1 to, e.g., −500 V, and the exposing device 3 exposes the photoconductive layer of the photoreceptor drum 1 in accordance with an image to be recorded. Upon exposure, the charge in the exposed portion of the photoconductive layer of the photoreceptor drum 1 is removed, and an electrostatic latent image is formed on that portion.

In the developing unit 4, a developing bias which is a low voltage such as −200 V having the same polarity as the charging potential of the photoconductive layer of the photoreceptor drum 1 is applied to a development roller. Consequently, no toner sticks to the charged portion of the photoreceptor drum 1 since the potential of the photoreceptor drum 1 is higher in that portion. On the other hand, the toner adheres to the exposed, charge-removed portion of the photoreceptor drum 1 because the potential of the photoreceptor drum 1 is lower in that portion.

Subsequently, sheets of recording paper P stored in a paper feed cassette (not shown) are picked up by a paper feed roller and separately fed one by one to the photoreceptor drum 1 by a separation roller.

The roller transfer device 5 includes a transfer roller 7 which is rotated in contact with the photoreceptor drum 1. To form a stable contact portion (nip), additional rollers (not shown) having a diameter smaller than outside diameter of the roller can be provided at the two ends of the core shaft of the transfer roller 7. A core shaft 8 of the transfer roller 7 is connected to a transfer power supply 15 and applied with a transfer bias.

While the recording paper P is being fed between the transfer roller 7 and the photoreceptor drum 1, charge (e.g., +1.35 kV) having opposite polarity to that of the toner is applied to the transfer roller 7, thereby transferring the toner sticking to the photoconductive layer of the photoreceptor drum 1 onto the recording paper P.

After the transfer, the residual toner that has not been transferred from the photoconductive layer of the photoreceptor drum 1 is removed by the cleaning unit 6.

FIG. 2 illustrates the structure of the transfer roller 7 used in the conventional roller transfer devices. Referring to FIG. 2, the outer circumferential surface of the core shaft 8 made of a metal is covered with a conductive urethane sponge elastic layer 9. A conductive vinyl chloride film 10 is formed as an adhesive layer on the outer circumferential surface of the conductive urethane sponge elastic layer 9. A fluorine-based seamless film 11 is formed as a resistance layer on the outer circumferential surface of the vinyl chloride film 10. Lastly, the transfer roller 7 with this structure is heated to bond these layers. Since it is difficult to directly fuse the fluorine-based seamless film resistance layer 11 and the conductive urethane sponge elastic layer 9 due to good release characteristics of the fluorine-based seamless resistance layer 11, these layers 9 and 11 are bonded by bonding their opposing surfaces via the vinyl chloride film 10.

The function of the conductive urethane sponge elastic layer 9 is to make the transfer roller 7 elastically contact with the outer circumferential surface of the photoreceptor drum 1. The fluorine-based seamless film 11 allows the surface of the transfer roller 7 to reliably feed recording paper, and suppresses wear of the transfer roller 7. Also, the layers 9, 10, and 11 are given conductivity in order to enable voltage application to the transfer roller 7.

In the above structure, the higher the adhesion temperature the higher the adhesive strength with which the fluorine-based seamless film resistance layer 11, the adhesive layer 10, and the conductive urethane sponge elastic layer 9 are bonded. The fluorine-based seamless film resistance layer 11 shows no large deformation even when heated to temperatures near the softening point only for a short time. On the other hand, the conductive urethane sponge elastic layer 9 is a very soft resin compared to the fluorine-based seamless film resistance layer 11. Accordingly, when heated to the softening point or higher temperatures only for a short time the conductive urethane sponge elastic layer 9 tends to deteriorate, e.g., to bring about an unwanted deformation or to impair the desired elasticity. This deterioration decreases the transfer roller performance. From this viewpoint, it is necessary to set the adhesion temperature to a temperature lower than the heat resistant temperature of the conductive urethane sponge. Since the conductive urethane sponge 9 deforms at about 150° C., the adhesion temperature of the fluorine-based seamless film resistance layer 11 and the conductive urethane sponge layer 9 is set at below about 150° C. Unfortunately, the fluorine-based seamless film resistance layer 11 has very good release characteristics and hence is difficult to bond, in comparison with the conductive urethane sponge elastic layer 9. Accordingly, the conventional transfer rollers have the problem that no satisfactory adhesive strength can be attained between the fluorine-based seamless film resistance layer 11 and the adhesive layer 10 and these layers readily peel, even when heating is done at below a temperature of approximately 150° C.

SUMMARY OF THE INVENTION

It is an object of the present invention to obtain a transfer roller with a high durability by increasing the adhesive strength between a fluorine-based film resistance layer and a conductive elastic layer which are bonded via an adhesion layer and thereby preventing peeling of this film, and to provide a roller transfer device with a high reliability and a high durability by use of this transfer roller.

According to the first aspect of the present invention, there is provided a roller transfer device comprising a transfer roller including a metal core shaft, a conductive elastic layer formed on the core shaft and having a heat resistance about 150° C. or more, an adhesive layer formed on the conductive elastic layer, and a fluorine-based film resistance layer formed on the adhesive layer, and a voltage application member connected to the transfer roller.

According to the second aspect of the present invention, there is provided a roller transfer device comprising a transfer roller including a metal core shaft, a conductive elastic layer formed on the core shaft, an adhesive layer formed on the conductive elastic layer, and a fluorine-based film resistance layer formed on the adhesive layer, and a voltage application member connected to the transfer roller, wherein an adhesive strength between the adhesive layer and the fluorine-based film resistance layer is 150 g/cm or higher.

According to the third aspect of the present invention, there is provided a method of manufacturing a transfer roller, comprising the steps of forming a conductive elastic layer on a metal core shaft, forming an adhesive layer on the conductive elastic layer, forming a fluorine-based film resistance layer on the adhesive layer, and heating the conductive elastic layer, the adhesive layer, and the fluorine-based film resistance layer at a heating temperature higher than 150° C., thereby bonding the conductive elastic layer and the fluorine-based film resistance layer.

According to the present invention, either the conductive elastic layer with a high heat resistance is used or the adhesive strength between the conductive elastic layer and the fluorine-based film resistance layer is set to 150 g/cm or higher. Consequently, it is possible to obtain a transfer roller having a practically satisfactory smoothness and a sufficient durability with which no peeling is caused, and to thereby provide an excellent roller transfer device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Roller transfer devices according to the present invention comprise a transfer roller including a metal core shaft, a conductive elastic layer formed on the core shaft, an adhesive layer formed on the conductive elastic layer, and a fluorine-based film resistance layer formed on the adhesive layer, and a voltage application member connected to the transfer roller. The roller transfer devices having this basic arrangement are roughly divided into the following two aspects according to the details of the arrangement.

According to the first aspect of the present invention, there is provided a roller transfer device using a transfer roller having a conductive elastic layer whose heat resistance is 150° C. or more.

The use of the conductive elastic layer whose heat resistance is 150° C. or more enables adhesion at higher temperatures than in conventional methods. At higher temperatures the fluorine-based film resistance layer and the adhesive layer are bonded more strongly, resulting in a higher adhesive strength. The heat resistance is preferably 160° C. to 180° C.

According to the second aspect of the present invention, there is provided a roller transfer device using a transfer roller in which a conductive resistance layer and an adhesive layer are bonded with a strength of 150 g/cm or higher.

With this strength of 150 g/cm or higher the fluorine-based film resistance layer and the adhesion layer are bonded more strongly than in conventional methods.

One method of manufacturing the transfer roller as discussed above is given by the third aspect of the present invention.

According to the third aspect of the present invention, there is provided a method of manufacturing a transfer roller, comprising the steps of forming a conductive elastic layer having a heat resistance of 150° C. or more on a metal core shaft, forming an adhesive layer on the conductive elastic layer, forming a fluorine-based film resistance layer on the adhesive layer, and heating the conductive elastic layer, the adhesive layer, and the fluorine-based film resistance layer at a heating temperature higher than 150° C., thereby bonding the conductive elastic layer and the fluorine-based film resistance layer.

When heated at a temperature higher than 150° C., the adhesive layer and the fluorine-based film resistance layer are bonded more strongly.

In any of the first to third aspects of the present invention, the adhesive strength between the adhesive layer and the fluorine-based film resistance layer is increased. Consequently, all portions of the conductive elastic layer, the adhesive layer, and the fluorine-based film resistance layer are stably bonded, and this improves the durability of the transfer roller.

Figure 1:
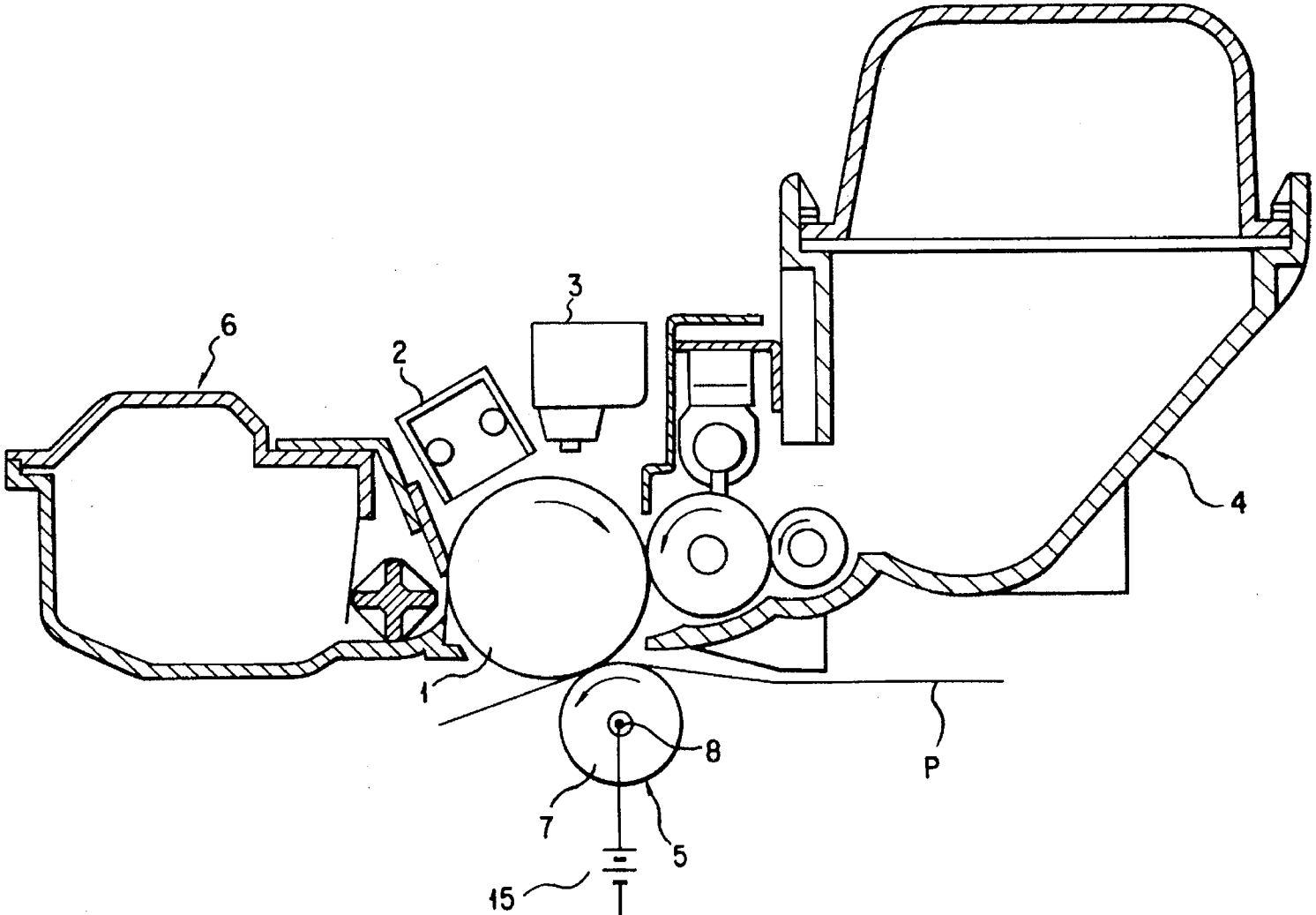
FIG. 1 is a sectional view showing the basic arrangement of process units of an electrophotographic apparatus.
Figure 2:
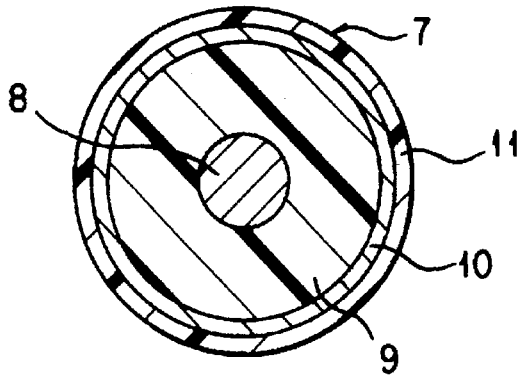
FIG. 2 is a sectional view showing an example of a transfer roller used in a conventional roller transfer device.
Figure 3:
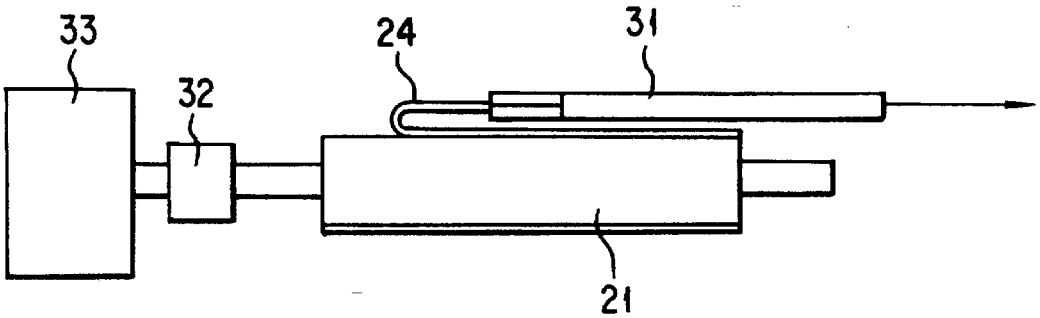
FIG. 3 is a view showing a test apparatus for measuring the adhesive strength of a film resistance layer.

In the present invention, the adhesive strength is the value measured by a 180° film peeling apparatus shown in FIG. 3. As in FIG. 3, a load cell 33 is coupled with a transfer roller 21 via a coupling 32, and a pulling member 31 is attached to a fluorine-based seamless film resistance layer 24 formed on the transfer roller 21. The fluorine-based seamless film resistance layer 24, which is bonded to a conductive ethyleneepropylene sponge elastic layer 23 of the transfer roller 21, is pulled by the pulling member 31. The resulting force acting on the transfer roller 21 is measured by the load cell 33 via the coupling 32.

In the first aspect of the present invention, the higher the adhesive strength between the adhesive layer and the fluorine-based film resistance layer the better, and the adhesive strength is preferably at least 150 g/cm.

In the transfer roller used in the present invention, this adhesive strength preferably exceeds 150 g/cm, and is more preferably 200 g/cm or higher. No upper limit is particularly provided in the strength since in the measurements done by the 180° film peeling apparatus, FIG. 3, if the adhesive strength exceeds the tear strength of the conductive elastic layer, the conductive elastic layer is torn during the measurement, and this makes the measurement of the adhesive strength impossible.

In the present invention, it is preferable that the conductive elastic layer have a heat resistance of 180° C. or more, an Asker C hardness of 25 to 38, and a volume resistivity of 10 to $10^6$.

Preferably, the conductive elastic layer essentially consists of an elastic resin layer and a conductive material dispersed in the elastic resin layer.

The conductive material can be selected from the group consisting of carbon, etheresteramide, and metal complex such as $LiCl_4$.

An ethylenepropylene sponge layer can be suitably used as the elastic resin layer.

Compared to a conventionally used conductive urethane sponge, the conductive ethylenepropylene sponge layer has a high heat resistance and does not deform up to a temperature of about 180° C. Consequently, it is possible to bond the fluorine-based film to the conductive ethylenepropylene sponge elastic layer at a temperature of, e.g., preferably 160° to 180° C., and more preferably 180° C., which is much higher than the conventional adhesion temperatures. The result is a transfer roller in which the fluorine-based film is strongly bonded and prevented from peeling.

The fluorine-based film resistance layer preferably has a volume resistivity of $10^8$ to $10^{12}$ Ω·cm.

It is desirable that the fluorine-based film resistance layer consist of a fluorine-based resin film and a conductive material dispersed in the fluorine-based resin film.

As the material of the fluorine-based resin film, it is possible to use at least one type of a material selected from the group consisting of polyvinylidene fluoride and a tetrafluoroethylene perfluoroalkylvinylether copolymer.

As the conductive material, it is possible to use at least one type of a material selected from the group consisting of carbon, and etheresteramide.

The material of the adhesive layer can be preferably chosen from the group consisting of a conductive vinyl chloride resin and a conductive polyurethane resin.

The adhesive layer desirably has a volume resistivity of not more than $10^6$ Ω·cm.

The fluorine-based film resistance layer preferably has a thickness of 40 to 80 μm.

Also, it is desirable that the transfer roller according to the present invention have a resistance of $10^6$ to $10^{10}$ Ω·cm$^2$ as a whole when the measurement is done at a temperature of 20° C. and a humidity of 50% by applying a 1-kV voltage for one minute. The Asker C hardness of the transfer roller is preferably about 25 to 50.

The present invention will be described below with reference to the accompanying drawings.

Figure 4:
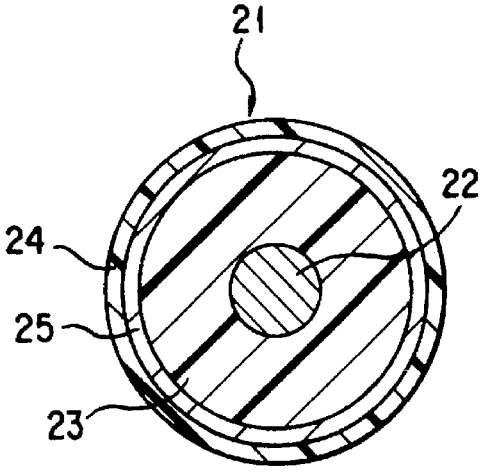
FIG. 4 is a sectional view showing one embodiment of a transfer roller used in a roller transfer device according to the present invention.

FIG. 4 shows one embodiment of the transfer roller according to the roller transfer device of the present invention. In FIG. 4, reference numeral 21 denotes a transfer roller having a diameter of such as 18 mm. This transfer roller 21 has a layered structure consisting of a metal core shaft 22 having a diameter of such as 8 mm, an elastic layer 23, an adhesive layer 25, and a fluorine-based seamless film resistance layer 24. The elastic layer 23 is formed on the outer circumferential surface of the core shaft 22 and made of a conductive ethylenepropylene sponge which is imparted conductivity by dispersion of, e.g., carbon. The adhesive layer 25 is fused on the outer circumferential surface of the conductive ethylenepropylene sponge elastic layer 23 and made of, e.g., a conductive vinyl chloride seamless film. The fluorine-based seamless film resistance layer 24 is fused on the outer circumferential surface of the adhesive layer 25.

The elastic layer 23 made of the conductive ethylenepropylene sponge has a volume resistivity of $1\times10^4$ to $1\times10^5$ Ω·cm and a hardness of 32 (Asker C hardness). The fluorine-based seamless film resistance layer 24 is formed by dispersing an organic conductive material, such as carbon or etheresteramide, in PVDF (polyvinylidene fluoride), PFA (a tetrafluoroethylene perfluoroalkylvinylether copolymer), or a fluorine-based material. The resistance of the layer 24 is adjusted to $10^{11}$ to $10^{13}$ Ω·cm. The film thickness of the layer 24 is 40 to 80 μm. Compared to a conventionally used conductive urethane sponge, the conductive ethylenepropylene sponge has a high heat resistance and does not deform up to about 180° C. Accordingly, the fluorine-based seamless film 24 can be fused to the conductive ethylenepropylene sponge elastic layer 23 at a temperature of 180° C., which is a much higher adhesion temperature than the conventional ones.

The resistance of the overall transfer roller 21 is almost determined by the fluorine-based seamless film resistance layer 24. The resistance per unit area is $10^6$ to $10^{10}$ Ω·cm$^2$ (when measured by application of 1 kV for one min. in a 20° C., 50% environment). The hardness is 42 (Asker C hardness).

It is desirable that the adhesive strength of the fluorine-based seamless film resistance layer 24 be 150 g/cm or higher in order to prevent peeling.

Figure 5:
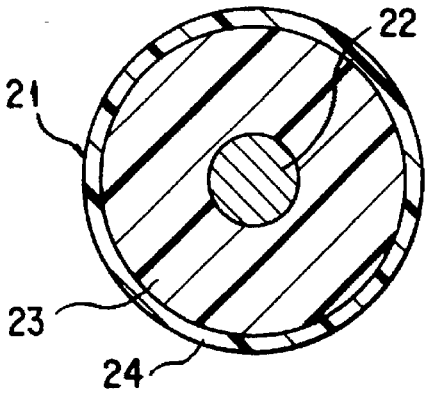
FIG. 5 is a sectional view showing another embodiment of the transfer roller used in the present invention.

FIG. 5 shows another embodiment of the present invention. In FIG. 5, the same reference numerals as in FIG. 4 denote the same parts. In this embodiment, a fluorine-based seamless film resistance layer 24 and a conductive ethylenepropylene sponge elastic layer 23 are bonded by using liquid conductive urethane as an adhesive.

The adhesive strength of the fluorine-based seamless film resistance layer 24 was measured using the 180° film peeling apparatus, FIG. 3. The width of the film 24 to be peeled was 10 mm, and a conductive vinyl chloride seamless film was used as an adhesive.

The measurement results were that the adhesive strengths at adhesion process temperatures of 150° C., 160° C., 170° C., and 180° C. were 130 g/cm, 150 g/cm, 300 g/cm, and 450 g/cm, respectively.

According to the above measurements, when the adhesive process temperature exceeded 180° C. the hardness of the conductive ethylenepropylene sponge elastic layer 23 decreased to produce wrinkles. Therefore, it is desirable that the process temperature be 160° to 180° C. Also, when the conductive urethane was used as an adhesive, the adhesive strength of the fluorine-based seamless film resistance layer 24 exceeded the tear strength of the sponge at process temperatures higher than 150° C.

Compared to a conventionally used conductive urethane sponge, the conductive ethylenepropylene sponge has a high heat resistance and does not deform up to about 180° C. Consequently, the fluorine-based film can be bonded to the conductive ethylenepropylene sponge elastic layer 23 at a temperature of 180° C., which is a much higher adhesion temperature than the conventional ones. This increases the adhesive strength between the fluorine-based seamless film resistance layer 24 and the conductive ethylenepropylene sponge elastic layer 23, compared with those in the conventional methods. As a result, the fluorine-based seamless film resistance layer 24 and the conductive ethylenepropylene sponge elastic layer 23 can be bonded with an adhesive strength high enough to prevent the fluorine-based seamless film resistance layer 24 from peeling from the conductive ethylenepropylene sponge elastic layer 23 while the roller is in use.

On the other hand, in comparison with the adhesion temperature and the peel strength of a conventional urethane sponge, if the adhesion temperature exceeds 150° C. the roller deforms to increase vibrations of the roller or produce wrinkles on recording paper. Therefore, the adhesion temperature needs to be 150° C. or lower, and the adhesive strength at 150° C. is around 150 g/cm. Accordingly, no adhesion temperature exists at which the adhesion strength is 150 g/cm or higher.

Note that silicone sponge is also a material with a high heat resistance which can be used as the conductive elastic layer. The silicone sponge does not deform even at a temperature of approximately 200° C. Unfortunately, because of good release characteristics of the material it is difficult to ensure an adhesive strength of 150 g/cm or higher even at elevated process temperatures.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A roller transfer device comprising:

a transfer roller including a metal core shaft, a conductive elastic layer formed on said core shaft and having a heat resistance of not less than 150° C., an adhesive layer formed on said conductive elastic layer, and a fluorine-based film resistance layer formed on said adhesive layer; and a voltage application member connected to said transfer roller;

wherein:

said conductive elastic layer has an Asker C hardness of approximately 25 to 38 and a volume resistivity of 10 to $10^6$ Ω·cm; and said adhesive layer essentially consists of at least one type of a material selected from the group consisting of a conductive vinyl chloride resin and a conductive polyurethane resin.

2. A device according to claim 1, wherein said heat resistance is 160° C. to 180° C.

3. A device according to claim 1, wherein a conductive material selected from the group consisting of carbon, etheresteramide and $LiCl_4$ is dispersed in said conductive elastic layer.

4. A roller transfer device comprising:

a transfer roller including a metal core shaft, a conductive elastic layer formed on said core shaft, an adhesive layer formed on said conductive elastic layer, and a fluorine-based film resistance layer formed on said adhesive layer; and a voltage application member connected to said transfer roller, wherein an adhesive strength between said adhesive layer and said fluorine-based film resistance layer is not less than 150 g/cm.

5. A device according to claim 4, wherein said conductive elastic layer has an Asker C hardness of approximately 25 to 38 and a volume resistivity of 10 to $10^6$ Ω·cm.

6. A device according to claim 4, wherein said conductive elastic layer is essentially constituted by an ethylenepropylene sponge layer in which a conductive material is dispersed.

7. A device according to claim 4, wherein said fluorine-based film resistance layer has a volume resistivity of $10^8$ to $10^{12}$ Ω·cm.

8. A device according to claim 4, wherein said fluorine-based film resistance layer essentially consists of at least one type of a fluorine-based resin selected from the group consisting of polyvinylidene fluoride, and a tetrafluoroethylene perfluoroalkylvinylether copolymer and a conductive material dispersed in said fluorine-based resin.

9. A device according to claim 8, wherein the conductive material is selected from the group consisting of carbon and etheresteramide.

10. A device according to claim 4, wherein said adhesive layer essentially consists of at least one type of a material selected from the group consisting of a conductive vinyl chloride resin and a conductive polyurethane resin.

11. A device according to claim 10, wherein the adhesive layer has a volume resistivity of not more than $10^6$ Ω·cm.

12. A device according to claim 11, wherein the fluorine-based film resistance layer has a thickness of 40 to 80 mm.

13. A device according to claim 4, wherein the adhesive strength is 200 g/cm$^3$ or higher.

14. A device according to claim 4, wherein said conductive elastic layer has a heat resistance of not less than 150° C.

15. A roller transfer device comprising:

a transfer roller including a metal core shaft, a conductive elastic layer formed on said core shaft and having a heat resistance of not less than 150° C., an adhesive layer formed on said conductive elastic layer, and a fluorine-based film resistance layer formed on said adhesive layer; and a voltage application member connected to said transfer roller, wherein:

said fluorine-based film resistance layer has a volume resistivity of $10^8$ to $10^{12}$ Ω·cm; and said adhesive layer essentially consists of at least one type of a material selected from the group consisting of a conductive vinyl chloride resin and a conductive polyurethane resin.

16. A device according to claim 15, wherein said heat resistance is 160° C. to 180° C.

* * * * *